US009886810B1

(12) United States Patent
Murphy

(10) Patent No.: US 9,886,810 B1
(45) Date of Patent: Feb. 6, 2018

(54) UNIVERSAL DISPENSER INTERFACE

(71) Applicant: GPCP IP Holdings LLC, Atlanta, GA (US)

(72) Inventor: David Warren Murphy, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 14/681,659

(22) Filed: Apr. 8, 2015

Related U.S. Application Data

(60) Provisional application No. 61/977,358, filed on Apr. 9, 2014.

(51) Int. Cl.
*G07F 11/00* (2006.01)
*G07F 9/00* (2006.01)

(52) U.S. Cl.
CPC ..... *G07F 11/002* (2013.01); *G07F 9/006* (2013.01)

(58) Field of Classification Search
CPC ..... G07F 11/002
See application file for complete search history.

(56) References Cited

U.S. PATENT DOCUMENTS 5,202,666 A 4/1993 Knippscheer
5,608,643 A 3/1997 Wichter et al.
5,610,589 A 3/1997 Evans et al.
5,691,919 A 11/1997 Gemmell et al.
5,793,653 A 8/1998 Segal
(Continued)

FOREIGN PATENT DOCUMENTS

AU 2011326640 A1 6/2013
AU 2012259412 A1 10/2013
(Continued)

OTHER PUBLICATIONS

U.S. Appl. No. 14/604,232, "Optimizing a Dispensing Parameter of a Product Dispenser Base on Product Usage Data", Unpublished (filed Jan. 23, 2015), (Brian Scott Borke, Inventor) (Georgia-Pacific Customer Products LP, assignee).
(Continued)

*Primary Examiner* — Gene O Crawford
*Assistant Examiner* — Stephen L Akridge
(74) *Attorney, Agent, or Firm* — Alston & Bird LLP

(57) ABSTRACT

The present invention provides a dispenser interface, associated methods and systems, and dispensers employing the dispenser interface and associated systems and methods. An example embodiment provides a product dispenser assembly for dispensing a product. The dispenser comprises a dispenser controller having a first communication interface; and a communication controller having a second communication interface. The second communication interface is operatively connected to the first communication interface. The communication controller is configured to be in communication with one or more devices. The communication controller is configured to receive a command from one of the one or more devices; and provide the command to the dispenser controller. The dispenser controller and communication controller are configured to cause (a) product to be dispensed, (b) dispenser data to be stored, or (c) dispenser data to be communicated in accordance with the command.

22 Claims, 6 Drawing Sheets

(56) References Cited

U.S. PATENT DOCUMENTS 5,812,059 A 9/1998 Shaw et al.
5,878,381 A 3/1999 Gemmell et al.
5,918,197 A 6/1999 Toussant et al.
5,945,910 A 8/1999 Gorra
5,952,924 A 9/1999 Evans et al.
6,236,317 B1 5/2001 Cohen et al.
6,250,452 B1 6/2001 Partyka et al.
6,360,181 B1 3/2002 Gemmell et al.
6,392,546 B1 5/2002 Smith
6,411,920 B1 6/2002 McConnell et al.
6,426,701 B1 7/2002 Levy et al.
6,727,818 B1 4/2004 Wildman et al.
6,837,395 B2 1/2005 Windorski et al.
6,882,278 B2 4/2005 Winings et al.
6,883,563 B2 4/2005 Smith
6,955,333 B2 10/2005 Patterson et al.
7,044,421 B1 5/2006 Omdoll et al.
7,131,575 B1 * 11/2006 Kolls ..... G06Q 30/06 235/379
7,182,217 B2 2/2007 Windorski et al.
7,213,782 B2 5/2007 Osborne et al.
7,242,307 B1 7/2007 LeBlond et al.
7,248,933 B2 7/2007 Wildman
7,370,824 B1 5/2008 Osborne
7,372,367 B2 5/2008 Lane et al.
7,375,640 B1 5/2008 Plost
7,425,900 B2 9/2008 Lynn et al.
7,443,305 B2 10/2008 Verdiramo
7,482,936 B2 1/2009 Bolling
7,551,092 B1 6/2009 Henry
7,603,471 B2 10/2009 Sodergren
7,605,704 B2 10/2009 Munro et al.
7,616,122 B2 11/2009 Bolling
7,659,824 B2 2/2010 Prodanovich et al.
7,682,464 B2 3/2010 Glenn et al.
7,726,599 B2 6/2010 Lewis et al.
7,755,494 B2 7/2010 Melker et al.
7,770,782 B2 8/2010 Sahud
7,774,096 B2 8/2010 Goerg et al.
7,782,214 B1 8/2010 Lynn
7,783,380 B2 8/2010 York et al.
7,791,490 B2 9/2010 Kennish et al.
7,804,409 B2 9/2010 Munro et al.
7,814,582 B2 10/2010 Reddy et al.
7,825,812 B2 11/2010 Ogrin et al.
7,855,651 B2 12/2010 LeBlond et al.
7,952,484 B2 5/2011 Lynn
7,982,619 B2 7/2011 Bolling
8,040,245 B2 10/2011 Koblasz
8,085,155 B2 12/2011 Prodanovich et al.
8,094,029 B2 1/2012 Ortiz et al.
8,110,047 B2 2/2012 Glenn et al.
8,154,412 B2 4/2012 Verdiramo
8,169,325 B2 5/2012 Verdiramo
8,169,327 B2 5/2012 Lynn
8,185,647 B2 5/2012 Sodergren
8,201,707 B2 6/2012 Ophardt
8,215,523 B2 7/2012 Ophardt
8,237,558 B2 8/2012 Seyed Momen et al.
8,558,701 B2 10/2013 Wegelin et al.
8,768,789 B2 7/2014 Smith et al.
8,774,963 B2 7/2014 Signorelli et al.
8,847,752 B2 9/2014 Wegelin et al.
9,007,936 B2 4/2015 Gaylard et al.
2001/0054083 A1 * 12/2001 Defosse ..... B67D 1/0878 709/217
2003/0073952 A1 * 4/2003 Flaherty ..... A61M 5/14248 604/151
2003/0088333 A1 * 5/2003 Liff ..... G06F 19/3462 700/237
2003/0210140 A1 11/2003 Menard et al.
2005/0060062 A1 * 3/2005 Walker ..... G06Q 10/087 700/236
2005/0134465 A1 6/2005 Rice et al.
2007/0061460 A1 3/2007 Khan et al.
2008/0001763 A1 1/2008 Raja et al.
2008/0078777 A1 * 4/2008 Cittadino ..... A47K 10/36 221/1
2008/0235105 A1 * 9/2008 Payne ..... G06Q 20/40 705/27.1
2008/0249658 A1 * 10/2008 Walker ..... G07F 9/02 700/236
2008/0313078 A1 * 12/2008 Payne ..... G06Q 20/40 705/44
2009/0070234 A1 * 3/2009 Peters ..... B67D 1/0041 705/26.1
2009/0195385 A1 8/2009 Huang et al.
2009/0224907 A1 9/2009 Sinha et al.
2009/0224924 A1 9/2009 Thorp
2009/0267776 A1 10/2009 Glenn et al.
2009/0320106 A1 * 12/2009 Jones ..... G06Q 20/1085 726/5
2010/0051637 A1 3/2010 Shu
2010/0117823 A1 5/2010 Wholtjen
2010/0134296 A1 6/2010 Hwang
2010/0219206 A1 9/2010 Ophardt
2010/0315243 A1 12/2010 Tokhtuev et al.
2010/0315244 A1 12/2010 Tokhtuev et al.
2010/0328076 A1 12/2010 Kyle et al.
2011/0068930 A1 3/2011 Wildman et al.
2011/0121974 A1 5/2011 Tenarvitz et al.
2011/0163870 A1 7/2011 Snodgrass
2011/0206378 A1 8/2011 Bolling et al.
2011/0254682 A1 10/2011 Sigrist Christensen
2011/0260872 A1 10/2011 Kennish et al.
2011/0316695 A1 12/2011 Li et al.
2012/0062378 A1 3/2012 Bolling
2012/0112914 A1 5/2012 Wegelin et al.
2012/0133213 A1 * 5/2012 Borke ..... H02J 17/00 307/104
2012/0158419 A1 6/2012 Nuthi
2012/0212582 A1 8/2012 Deutsch
2012/0245729 A1 9/2012 Wegelin et al.
2013/0045685 A1 2/2013 Kiani
2013/0238116 A1 * 9/2013 Smith ..... G07F 11/54 700/217
2013/0262034 A1 10/2013 Iseri et al.
2014/0015670 A1 1/2014 Wegelin et al.
2014/0104062 A1 4/2014 Weiner
2014/0138401 A1 5/2014 Ophardt et al.
2014/0142748 A1 5/2014 Geigel et al.
2014/0361898 A1 12/2014 Wegelin et al.

FOREIGN PATENT DOCUMENTS

CA 2817080 A1 5/2012
CA 2830715 A1 11/2012
CN 103209626 A 7/2013
CN 103443595 A 12/2013
EP 2637540 A2 9/2013
EP 2689217 A1 1/2014
JP 2013543757 A 12/2013
JP 2014515137 A 6/2014
KR 2013140717 A 12/2013
KR 2014010962 A 1/2014
MX 2013005161 A 5/2013
MX 2013010867 A 10/2013
TW 201218996 A 5/2012
TW 201240496 A 10/2012
WO WO 2012/064515 A2 5/2012
WO WO 2012/161766 A1 11/2012

OTHER PUBLICATIONS

United States Patent and Trademark Office, Office Action for U.S. Appl. No. 14/681,700, dated Jul. 18, 2016, 14 pages, U.S.
United States Patent and Trademark Office, Notice of Allowance for U.S. Appl. No. 14/681,700, dated Jul. 24, 2017, 10 pages, U.S.

(56) References Cited

OTHER PUBLICATIONS

United States Patent and Trademark Office, Office Action for U.S. Appl. No. 14/681,700, dated Feb. 28, 2017, 10 pages, U.S.

* cited by examiner

UNIVERSAL DISPENSER INTERFACE

CROSS-REFERENCE TO RELATED APPLICATIONS

This application claims priority to U.S. Provisional Application Ser. No. 61/977,358, filed Apr. 9, 2014, which is hereby incorporated herein in its entirety.

BACKGROUND

Related Field

The present invention relates to a dispenser interface for electronic dispensers, methods and systems related to the dispenser interface, dispensers employing the dispenser interface, and methods and systems related to dispensers employing the dispenser interface.

Description of Related Art

Dispensers are well known for dispensing various products. For example, automated dispensers for dispensing consumable products to consumers have become popular in the industry. The consumable products may include liquid or foam soap, sanitizer (e.g., gel or alcohol sanitizer), paper or other towels, tissue, napkins, film, plastic cutlery, wipers, nonwoven items, sheet products, and the like.

In various contexts it may be helpful to electronically interface with an electronic dispenser. For example, in a healthcare, food preparation, or other situation, it might be beneficial to track use of soap and hand sanitizer dispensers to ensure hand hygiene practices are in line with the appropriate protocols. In various applications, the usage of a dispenser may be tracked to determine when the dispenser needs to be refilled with product to be dispensed or when a battery within the dispenser is nearing the end of its life (e.g., in embodiments wherein power supply 120 comprises a battery or set of batteries). The dispensers typically include an electronic dispenser board that can serve various functions, including causing the dispenser to dispense product and log the amount of product dispensed. To track use of one or more dispensers may require that an external system be able to communicate with each of the dispensers. However, dispensers generally don't include standardized components providing for communicating with the external system. Additionally, dispensers come in a variety of unique configurations such that, depending on the type and number of dispensers to be interfaced with, this may be a difficult, inefficient, and labor intensive process.

One approach for interfacing with a dispenser is to provide a daughter card in communication with the main dispenser board of the dispenser. The daughter card is typically mounted in or on the dispenser, and can be programmed to provide advanced features for the dispenser, including providing for communication between the main dispenser board and external systems. Thus, dispensers of one type can be manufactured by one company with a main dispenser board providing basic functions such as dispensing and dispense logging, and then some of these dispensers can be made more advanced or otherwise customized by the same or a different company. This is accomplished by adding specialized daughter cards. However, to date such arrangements have required a multitude of customized hardware and software configurations so as to facilitate communication between a variety of main dispenser boards and associated daughter cards, resulting in inefficiencies of scale for daughter card manufacturers and suppliers.

Thus, there is a need in the art for an improved, efficient dispenser interface and associated methods, apparatuses, and systems. In addition, a need exists for a dispenser interface that advantageously allows for a wide variety of main dispenser boards to communicate easily with other systems, such as one or more daughter cards provided on the dispenser and external systems.

SUMMARY

Various embodiments of the present invention provide a dispenser interface for electronic dispensers and related methods and systems. Various embodiments of the present invention also provide an electronic dispenser using the dispenser interface and related methods and systems. According to certain embodiments, the dispenser interface is configured to define a standard communication protocol for electronic dispensers. Additionally, the dispenser interface provided can be configured to minimally affect the battery life of the dispenser (e.g., in embodiments wherein power supply 120 comprises a battery or set of batteries). In various embodiments the dispenser interface may define electrical hardware and/or software protocols for interfacing with the dispenser.

In various embodiments, the dispenser interface also defines the list of data and events that a particular dispenser communicates and the timing/priority of such communications. In various embodiments, the dispenser interface allows for a modular architecture. For example, the dispenser interface can be present on the main dispenser board and a daughter card may be added to the dispenser and communicate with the dispenser via the dispenser interface to enable and/or add various functions.

In various embodiments, the dispenser interface may be configured to be used in a wide variety of dispensers, regardless of the product the dispenser dispenses (e.g., paper towel, tissue, soap, hand sanitizer, etc.). Therefore, a daughter card that implements special functionality and communicates with the dispenser via the dispenser interface may be added substantially seamlessly to any dispenser that supports the dispenser interface and in which the special functionality is desired.

In one aspect, a method of configuring a communication interface of a dispenser controller configured to control a dispenser for dispensing hygiene products or other products is provided. In various embodiments, the method may comprise operatively connecting a communication controller to the communication interface of the dispenser controller, the communication controller configured to communicate with one or more remote computing devices; and transmitting, via the communication interface and from the communication controller and to the dispenser controller, configuration information, the configuration information comprising at least one of: a communication protocol, instructions indicating dispenser information to be communicated in association with the occurrence of at least one type of dispenser event, instructions associated with how to communicate dispenser information associated with at least one type of dispenser event to the communication controller, and a priority indicator associated with at least one type of dispenser event.

In another aspect a product dispenser assembly for dispensing a hygiene product or other product is provided. In various embodiments, the dispenser may comprise a dispenser controller having a first communication interface;

and a communication controller having a second communication interface, the second communication interface connected to the first communication interface via a connector, the communication controller configured to be in communication with one or more remote computing devices, wherein the communication controller provides configuration information to the dispenser controller via the first and second communication interfaces, the configuration information comprises at least one of: a communication protocol, instructions indicating dispenser information to be communicated in association with the occurrence of at least one type of dispenser event, instructions associated with how to communicate dispenser information associated with at least one type of dispenser event to the communication controller, and a priority indicator associated with at least one type of dispenser event.

In yet another aspect, a product dispenser assembly for dispensing a product is provided. In various embodiments, the product dispenser assembly comprises a dispenser controller having a first communication interface and a communication controller having a second communication interface. The second communication interface is operatively connected to the first communication interface. The communication controller is configured to be in communication with one or more devices. The communication controller is further configured to receive a command from one of the one or more devices and provide the command to the dispenser controller. After receiving the command, product is dispensed, dispenser data is stored, or dispenser data is communicated in accordance with the command.

In still another aspect, a method for controlling a dispenser for dispensing products is provided. In various embodiments, the method comprises establishing a communication connection with a communication controller and providing a command to the communication controller. The communication controller is operatively connected to a communication interface of a dispenser controller configured to control the dispenser. The command originates from a remote computing device. The communication controller is configured to provide the command to the dispenser controller. After receiving the command, product is dispensed, dispenser data is stored, or dispenser data is communicated in accordance with the command.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

General Overview

Figure 1:
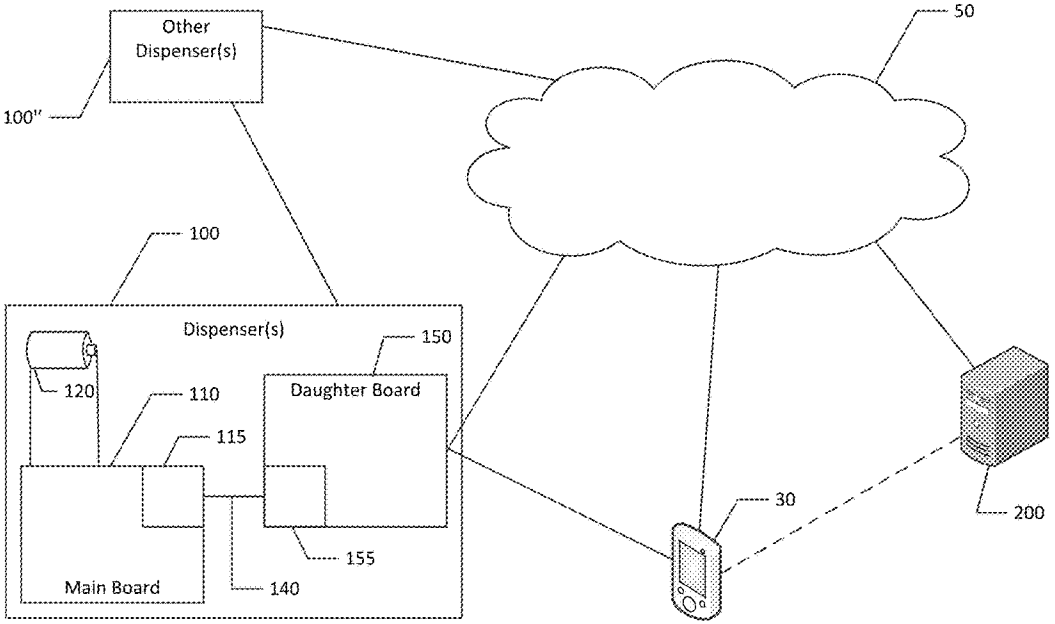
FIG. 1 is an overview of a system that can be used to practice embodiments of the present invention.

FIG. 1 illustrates an exemplary architecture of a system incorporating a dispenser employing the dispenser interface according to various embodiments of the present invention. For example, dispenser 100 includes a dispenser controller, also referred to herein as a main board 110 and/or with similar terms. The main board 110, according to various embodiments comprises a dispenser interface 115. The dispenser interface 115 may be a universal dispenser interface configured to interface with a variety of add-on modules or daughter cards.

According to various embodiments, the dispenser 100 may also comprise a communication controller, also referred to herein as a daughter card 150, daughter board, and/or with similar terms. Various embodiments may comprise one or more daughter cards 150. Some embodiments comprise one or more splitter daughter cards, wherein at least one of the daughter cards is in communication and/or operatively connected to at least one other daughter card, in for example a "daisy-chain" type configuration. In certain embodiments, the daughter card 150 comprises a card interface 155. The daughter card 150 may be in communication with the main board 110 via connection 140. Particularly the main board dispenser interface 115 may be in communication with the daughter card interface 155 via connection 140. In various embodiments, the connection 140 may be a wired connection (e.g., ribbon connection and/or the like), a direct connection (e.g., edge connector and/or the like), or a wireless connection (e.g., low energy Bluetooth and/or the like).

According to various embodiments, the daughter card 150 may be mounted inside the dispenser and to the main board 110 as shown or maybe mounted on or adjacent to the dispenser. In certain embodiments, the daughter card could also be manually removable from the dispenser, and such embodiments could use a standardized connector geometry, such as a USB connector, so that the daughter card could be connected manually to an external computer system after removal from the dispenser. In addition, it is not necessary for the main board and daughter board to be separate structures, and the boards could form parts of an integrated structure, however as may be desirable for particular applications. For example, in one embodiment, the main board 110 and the daughter card 150 may be formed on the same board and the connection 140 may be traces on the printed circuit board on which the main board 110 and daughter card 150 are formed.

The dispenser can communicate with one or more external systems, which may include one or more computing devices. For example, the external system may include a point-of-sale system, an inventory management system, an order management system, an operations management system, a comprehensive management system and/or the like. The discussion below refers to a management system 200 (as illustrated in FIG. 1); in other embodiments, however, a variety of other external computing systems may be incorporated into the system in place of and/or in addition to the management system 200, as appropriate for a particular application. It should be understood that the management system 200, as described, may be configured to perform a plurality of tasks and/or functions, as desirable, including the non-limiting examples of remotely controlling and/or issuing commands to the dispenser, remotely configuring the dispenser, and tracking, predicting, analyzing, and reporting observations based upon available data and the like.

In these and other embodiments, the dispenser 100 may be in communication with the management system 200 via one or more wired or wireless networks 50. For example, the daughter card 150 may communicate with the management system 200 via a removable memory device (e.g., a USB enabled flash drive, and/or the like), Bluetooth, low energy Bluetooth, radio frequency communication, a Wi-Fi network, a cellular network, ANT, Zig Bee, proprietary network, or a combination thereof. For example, the daughter card 150 may communicate with the management system 200 via low energy Bluetooth—a low power consumption radio frequency communication technology. The daughter card 150 may be configured to communicate in accordance with one or more wired or wireless protocols.

In one embodiment, the daughter card 150 may additionally or alternatively be in communication with a computing device 30 which may act as a bridge between the management system 200 and the dispenser 100. In this manner, data collection and/or transmission between the dispenser 100 and management system 200 may occur via the computing device 30. For example, the computing device 30 may be a smartphone, tablet, portable computing device, bridge, relay, and/or the like configured to interface with the daughter card 150 and the management system 200. One non-limiting example is that the computing device 30 is a smartphone operating an application configured to communicate with the daughter card 150 (e.g., via Bluetooth, Bluetooth low energy (BLE), a wired connection, broadband connection, cellular connection, and/or the like) and receive data therefrom. For example, in a non-limiting embodiment, the smartphone application may be activated (e.g., commissioned) such that the smartphone may communicate with the daughter card 150. In one embodiment, a user of the smartphone may provide input indicating a Personal Identification Number (PIN), password, access code, and/or the like such that the smartphone application may be activated (e.g., commissioned) to communicate with the daughter card 150.

In another non-limiting example, the computing device 30 may be a bridge, router and/or the like mounted in the vicinity of one or more dispensers 100. The computing device 30 may be configured to communicate with the one or more dispensers 100 via a short range, low energy communication protocol. For example, a daughter card 150 associated with one of the one or more dispensers 100 may communicate with the computing device 30 via Bluetooth, BLE, short range radio communications, ANT, Zig Bee, other low energy communication protocol, and/or the like. The computing device 30 may then communicate with the management system 200 via a Wi-Fi network, a wired network, a cellular network, and/or the like.

In various embodiments, the dispenser 100 may be in direct communication with one or more other dispensers 100" and/or may communicate with one or more other dispensers 100" via one or more networks 50. For example, each dispenser 100" may be associated with a daughter card configured to communicate with the daughter card 150 via Bluetooth, BLE, radio frequency communications, Wi-Fi, one or more wired or wireless networks, a cellular network, and/or the like. In one embodiment, a dispenser 100 may be in direct communication with one or more other dispensers 100" and may be in indirect communication with the management system 200 via one of the other dispensers 100" (e.g., one of the dispensers 100" may act as a gateway for one or more dispensers 100).

Figure 2:
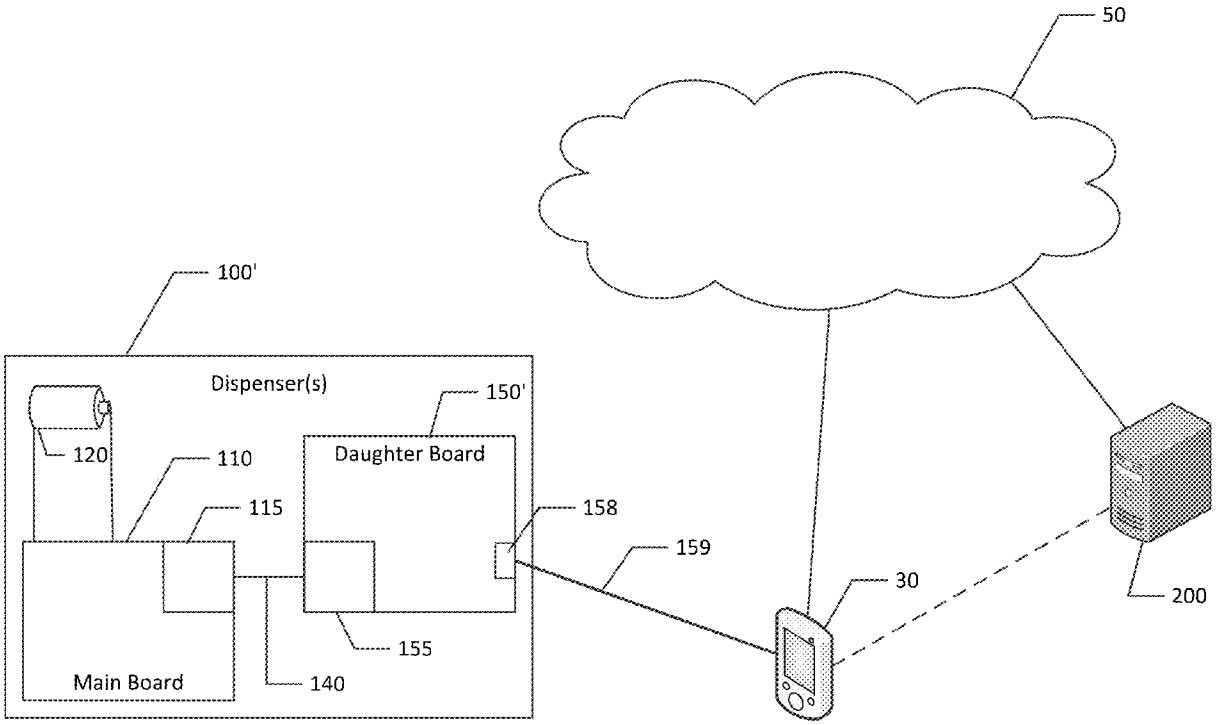
FIG. 2 is an overview of another system that can be used to practice embodiments of the present invention.
Figure 3:
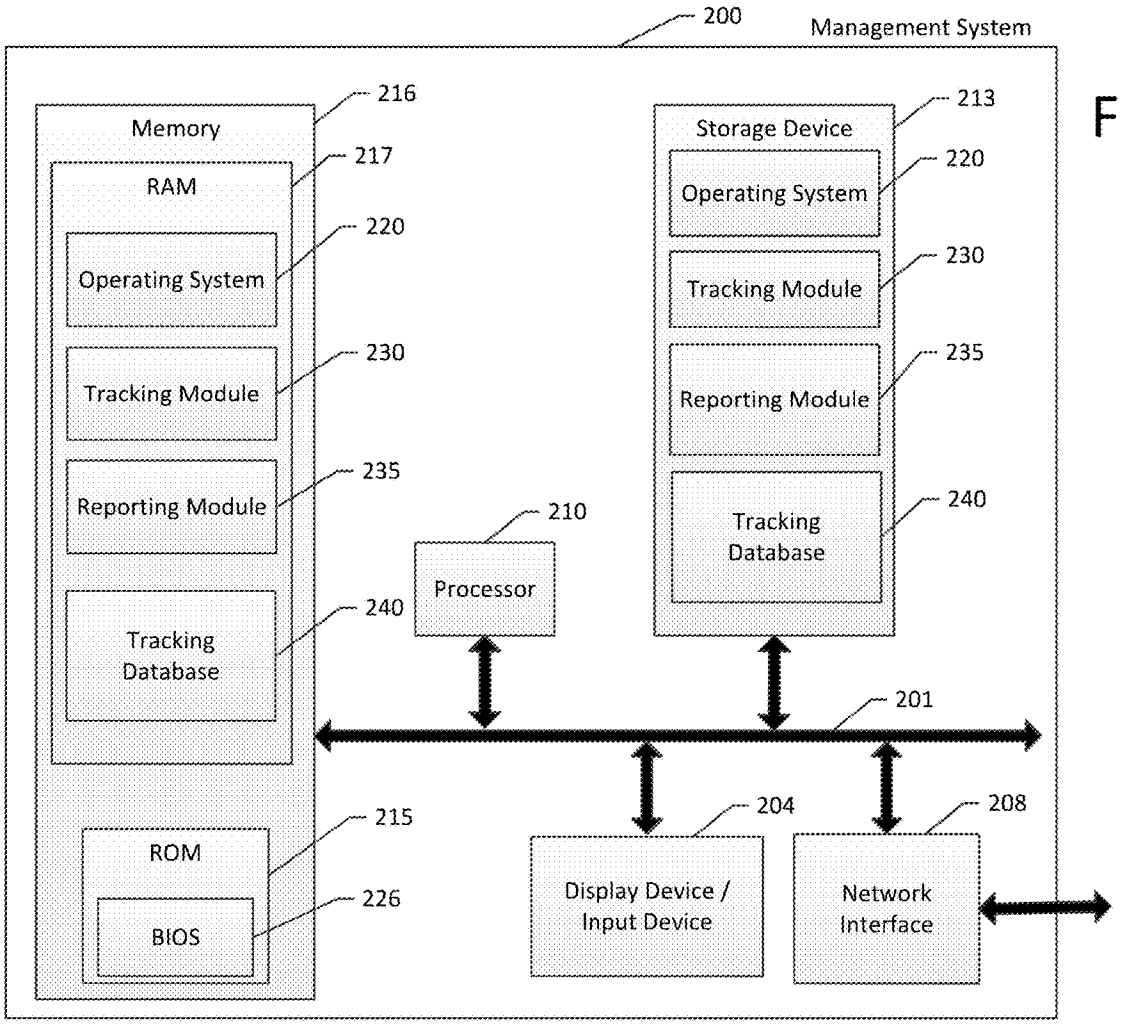
FIG. 3 is an exemplary schematic diagram of a management system according to one embodiment of the present invention.

FIG. 2 illustrates another exemplary architecture of a system incorporating a dispenser employing the dispenser interface according to various embodiments of the present invention. Particularly, FIG. 2 illustrates a dispenser 100' comprising a main board 110 in communication with a daughter card 150'. The daughter card 150' may comprise and/or be configured to communicate with a computing entity (e.g. computing device 30, management system 200, and/or the like) via a wired universal serial bus (USB) connection. For example, the daughter card 150' may comprise or be in communication with a USB port 158. The USB port 158 may be accessible from the exterior of dispenser 100' or may be accessed via removing a cover and/or the like. In various embodiments, a USB port cover may be secured such that a key, passcode, keyed tool, and/or the like is necessary to access USB port 158. As illustrated in FIG. 2, for example, computing device 30 may communicate with the daughter card 150' via USB wire 159 operably inserted into the USB port 158.

Exemplary Dispensers 100

In various embodiments, the dispenser 100 may be configured to dispense tissues, paper towels, wipes, nonwovens, napkins, other sheet products, liquid soap, gel soap, foam soap, hand sanitizer, air freshener, fragrance product, odor controlling agent, plastic cutlery, cups, plates, cup lids, condiments, and/or the like. For example, the dispenser 100 may be a soap or hand sanitizer dispenser located within a healthcare facility, food preparation area, and/or the like. In another example, the dispenser 100 may be a plastic cutlery or napkin dispenser located within a cafeteria or fast food location. It should be understood that a dispenser 100 may be configured to dispense a variety of items as appropriate for various circumstances. In some embodiments, the universal interface is incorporated into other items such as a trash receptacle, a motion sensor (e.g., for sensing when people enter or leave a room), and/or the like.

In various embodiments, the dispenser 100 may be powered by power supply 120 (e.g., a battery, set of batteries, solar power array, generator, connection to line voltage, any device configured to generate and/or otherwise provide a power source, and/or the like). For example, the main board 110 may be powered by power supply 120. The main board 110 may be configured to generate and/or receive triggers related to various dispenser events. For example, a motion sensor, button, lever, and/or the like may be activated, causing the main board 110 to receive an activation signal and/or to generate a dispense signal, either of which may be configured to cause the dispenser to dispense the product. For example, in a soap or sanitizer dispenser, the dispense signal may cause a motor to actuate a pump to dispense liquid or foam soap or sanitizer. In a towel dispenser, the dispense signal may cause a motor to rotate a driver roller, causing a towel to be dispensed. In a cutlery dispenser, a dispense signal may cause a motor to rotate a cam or move a pusher or stop member, enabling the next cutlery piece to descend from the dispenser.

The main board 110 may also receive and/or generate signals related to the battery power being low, a fault occurring, the reservoir of dispensable product running low, and/or the like. The received and/or generated triggers and/or associated information and/or dispenser parameters are collectively referred to herein as dispenser information/ data. For example, a trigger indicating that a dispense event occurred, a parameter indicating the current state of the motor or a control switch, a parameter indicating the current state of a configuration switch (e.g., sheet length and/or amount of product to be dispensed per activation, delay settings (e.g., minimum permissible time between consecutive dispense requests), sensor range, dispenser mode, and/or the like), a trigger that the battery voltage is low, a trigger that the reservoir of product to be dispensed is below a predetermined limit, operational data related to various triggers including the type of product dispensed, the time of the dispense, the amount of product dispensed, the length of time between consecutive dispense requests or activations, whether the dispense was terminated prematurely (e.g., by activation of a tear bar and/or the like), dispense mode (e.g., was the dispenser remotely activated, activated via a motion sensor, and/or the like), product identifier, product authenticity data, product distributor data, and/or the like may be considered dispenser information/data.

The main board 110 may be in communication with sensors associated with monitoring the state of the dispenser. For example, an example paper towel dispenser may comprise sensors configured to sense whether a stub roll or main roll is in use (e.g., which roll a dispense came from), the amount of paper towel remaining on the main roll, if the main roll is small enough to move to the stub roll position, the amount remaining on the stub roll, and when a transfer has occurred (e.g., when a transfer bar automatically feeds the main roll into the drive roller when the stub roll ends so the dispenser may dispense from the main roll). The dispenser may also include a sensor to determine when a cover is open, when a user is within a specified range of the dispenser, the position of the tear bar, the current voltage reading of a dispenser battery, and/or the like. The dispenser may further include a motor feedback switch, cam switch, motor encoder switch, and/or the like configured to determine the direction the motor is spinning, how fast the motor is spinning, how many rotations the motor has made, and/or the like. For example, the amount of product dispensed may be determined based on the amount of time the motor was spinning and the rate at which the motor was spinning, the number of rotations the motor made, and/or the like. In various embodiments, the motor feedback switch measures the degree of rotation or orientation of the drive roller shaft or another rotating part of the dispenser that is geared and/or coupled to the motor rather than measuring degree of rotation or orientation of the motor shaft itself. For example, a cam may be mounted on the drive roller shaft of a paper towel dispenser and associated with a cam switch that is activated via movement of the cam. The drive roller may be configured to feed the paper towel through the dispenser by forming a nip with a pinch roller. Thus, the length of paper towel dispensed may be determined by the number of rotations made by the drive roller. In another example, a cam in a soap or hand sanitizer dispenser may be used to translate the rotation of the motor into a linear movement to drive the dispensing mechanism up and down. The cam may be further associated with a cam switch that is activated via movement of the cam such that the number of times the dispensing mechanism moves up and down may be counted and the amount of soap or hand sanitizer dispensed may be determined by the number of cycles the motor caused the dispense mechanism to complete. In yet another example, the degree of rotation of a drive component of a cutlery or condiment dispenser may be used to determine if enough rotation was completed to complete the dispensation of one piece or package of cutlery or condiment packet, multiple pieces or packages of cutlery or condiment packet, and/or the like. As should be understood, various sensors may be incorporated into the dispenser 100 as appropriate for the application and type of dispenser. The main board 110 may receive information/data from each sensor in the dispenser and may be configured to provide information/data/parameters to one or more of the sensors.

The main board 110 may also have recorded thereon dispenser installation data reflecting parameters of the initial installation of the dispenser including the location of the dispenser in the world, the name of the building the dispenser is located in, the location of the dispenser in the building, the location of the dispenser in a particular washroom, the time and date of the initial commissioning of the dispenser, the customer account the dispenser is associated with, the type of product to be dispensed by the dispenser, the type of building in which the dispenser is installed (e.g., office, hospital, school, airport, etc.), the type of room the dispenser is located in (e.g., men's restroom, women's restroom, unisex or family restroom, cafeteria, public space, and/or the like), and the identity of the distributor though which the dispenser was sold. In some embodiments, the dispenser installation data may further comprise a time and date of decommissioning (if, for example, a dispenser is removed from service), a replacement dispenser serial number (e.g., if a dispenser is decommissioned and replaced by a new dispenser, the serial number of the new dispenser is a replacement dispenser serial number), and/or a reason for decommissioning. In some embodiments, the dispenser installation data may be stored on the management system 200 in addition or instead of storing the dispenser installation data on the main board 110.

In various embodiments, the dispenser interface 115 may be configured to pass the dispenser information/data to the daughter card 150 via the daughter card interface 155 and the connection 140. In various embodiments, the dispenser interface 115 may be configured to communicate with the daughter card interface 155 via various communication protocols. In various embodiments, the daughter card 150 may configure the dispenser interface 115 to communicate with the daughter card interface 155 via one of the various communication protocols, as described in more detail below. For example, the dispenser interface 115 may be configured to communicate with the daughter card interface 155 via one or more industry standard protocols such as universal asynchronous receiver/transmitter (UART), Serial Peripheral Interface 3 (SPI3), Serial Peripheral Interface 4 (SPI4), Inter-Integrated Circuit (I2C) protocols, and/or the like. In one embodiment, UART protocol is set as the default communication protocol for the dispenser interface 115 unless the daughter card 150 requests to use a different communication protocol. Thus, a daughter card 150 or other device may communicate with the dispenser interface 115 via a communication protocol already supported by the daughter card 150 or other device. By allowing the daughter card 150 to configure the communication protocol and communication configuration of the dispenser interface 115, a variety of different types of daughter cards may be used with the same basic dispenser design. Thus, custom functionality of a dispenser may be provided through the daughter card 150 while maintaining a low manufacturing cost for the basic dispenser.

As noted above, the communication between the dispenser interface 115 and the daughter card interface 155 may occur via the connection 140. In various embodiments, the connection 140 may include up to 14 or more pins, depending on the application. In various embodiments, the use of at least some of the pins may be dictated by the mode of communication to be used. For example, in one embodiment, pin 1 may be a general purpose input output (GPIO) pin, an I2C clock pin, or a Serial Peripheral Interface (SPI) slave out master in pin. The purpose of some pins may not be communication mode dependent. For example, one or more pins may be ground pins and one or more pins may carry the battery voltage and/or other power supply to power the daughter card 150, as described above, regardless of communication mode. Some pins may be used for joint test action group (JTAG) firmware upgrades, and/or the like. In other embodiments, the connection 140 may employ other pin outs in order to meet requirements of the application at hand.

In various embodiments, the functionality of one or more pins of the connection 140 may be configurable. For example, the daughter card 150 may provide information to the dispenser interface 115 configuring and/or changing the functionality of one or more pins of the connection 140. For example, a pin may be a GPIO pin configured to correlate to a particular event. For example, the pin may correspond to a dispense event, a low battery voltage reading, the status of a configuration switch, and/or the like. For example, a particular type of dispenser event may be assigned to a particular pin and the dispenser information/data associated with that type of dispenser event is then communicated over the assigned pin. In various embodiments, the pin may be configured to indicate a level associated with the event (e.g., the pin will mirror the activity level of the event). For example, the pin will indicate active when a motor is being actuated and will indicate inactive when the motor is not actuated. In various embodiments, the pin may be configured to provide a pulsed output (e.g., the pin will send a single EVENT_TIME duration pulse every time the event transitions from inactive to active). For example, after a dispense event occurs, pin may be held in the active position for a predetermined length of time. In various embodiments, a pin may be configured to toggle the state of the pin every time the event transitions from inactive to active. For example, if the amount of product in the reservoir of dispensable product falls below a threshold, the corresponding pin may switch states (e.g., high to low), indicating the reservoir of dispensable product is low. When the reservoir of dispensable product again falls below the threshold (e.g., after the product has been replaced), the corresponding pin may switch states again (e.g., low to high). In various embodiments, a pin may latch into the active state and remain there until a ClearLatchedOutputs input event is received. For example, if a fault code is generated, the associated pin may latch into the active state until maintenance personal address the issue that caused the fault code and provide a ClearLatchedOutputs input event. Thus, it should be understood that the communication protocol and preferences of the dispenser interface 115 and the pins of the connection 140 may be configured in various ways by the daughter card 150 as appropriate for the application.

The daughter card 150 may receive the dispenser information/data and store the dispenser information/data in memory associated with the daughter card (e.g., memory onboard the daughter card, associated with the daughter card, or local thereto) and/or may provide the dispenser information/data to a computing device 30 and/or another system (e.g., the management system 200). The daughter card 150 may have a Real Time Clock capability, and in embodiments of the invention the Real Time Clock would not require user intervention to set the time. In various embodiments, the dispenser information/data may be associated with a time stamp (such as in coordinated universal time (UTC) format) which may also be stored in memory associated with the daughter card 150. In various embodiments, the daughter card 150 may be configured to communicate in accordance with air interface standards of applicable wireless systems. In this regard, the daughter card 150 may be configured to operate with one or more air interface standards, communication protocols, modulation types, and access types. More particularly, the daughter card 150 may operate in accordance with any of a number of wired and/or wireless communication standards and protocols, such as those described below with regard to the management system 200 and/or the computing device 30. For example, the daughter card 150 may be configured to communicate with a computing device 30 via a USB connection, a Bluetooth® connection, a BLE connection, a cellular network connection, a Wi-Fi connection, and/or the like. Thus, for example, the daughter card 150 can communicate with one or more computing devices 30 and/or one or more management systems 200 using concepts such as Unstructured Supplementary Service Data (USSD), Short Message Service (SMS), Multimedia Messaging Service (MMS), Dual-Tone Multi-Frequency Signaling (DTMF), and/or Subscriber Identity Module Dialer (SIM dialer), Hypertext Transfer Protocol (HTTP) over Transport Layer Security (TLS), HTTP over Secure Sockets Layer (SSL), or HTTP Secure (HTTPS), and/or the like.

The daughter card 150 can also download changes, add-ons, and updates, for instance, to its firmware, software (e.g., including executable instructions, applications, program modules), and/or operating system. In various embodiments, the dispenser interface 115 may define and/or provide access to programming pins that may allow the dispenser firmware to be updated via the dispenser interface. For example, the daughter card 150 may download firmware updates and provide the firmware updates to the main board 110 via the dispenser interface 115. In various embodiments, this may allow the dispenser 100 firmware to be updated remotely and without disassembling the dispenser. In these and other embodiments, such updates are facilitated via and through the daughter card 150. In this manner, the daughter card is configured to execute control over the main board 110. For example, the daughter card 150, in some embodiments, may be configured to customize or otherwise direct the configuration of the main board 110.

In some embodiments, the daughter card 150 may transmit and/or provide dispenser information/data to management system 200 in real-time, periodically, when the daughter card's 150 local memory storage is full, when the information related to the dispenser events is requested by a computing device 30 or the management system 200, and/or the like. The information related to the dispenser information/data may be transmitted and/or provided from the daughter card 150 to the management system 200 via a wired or wireless network 50 and/or via another device (e.g., a bridge, a Bluetooth enabled computing device, a flash drive, a wired connection, and/or the like). For example, as shown in FIG. 1, the daughter card 150 may be in communication with a computing device 30. In various embodiments the computing device 30 is a bridge, relay, Bluetooth enabled mobile telephone/smartphone, laptop, and/or the like. In such an example, the daughter card 150 may communicate with the computing device 30 via short range Bluetooth communications, BLE communications, radio frequency communications, Wi-Fi, ANT, Zig Bee, cellular, proprietary, and/or other mode of communication configured to minimally effect the life of power supply 120, as appropriate for the application. For example, in some embodiments, the daughter card 150 may communicate with the computing device 30 via BLE communications such that the communication between the daughter card 150 and computing device 30 is energy efficient.

In one non-limiting example, the computing device 30 may be a smartphone operating an application configured to allow the smartphone to communicate with one or more daughter cards 150. A user operating the smartphone may provide input to the application operating on the smartphone indicating a PIN, password, access code, and/or the like. The application may be configured to provide one or more input events to the daughter card 150 and/or receive dispenser information/data related to one or more output events from the daughter card 150. The smartphone application may be configured to provide a PIN, password, access code, and/or the like to the daughter card 150 before the smartphone application may provide one or more input events to the daughter card 150 and/or receive dispenser information/data related to one or more output events from the daughter card 150. The smartphone may be configured to communicate with the daughter card 150 via a wireless connection (e.g., Bluetooth, BLE, Wi-Fi, broadband, and/or the like) or a wired connection (e.g., via a USB cable and/or the like). The dispenser information/data received by the smartphone application may be stored locally, provided to the management system 200, and/or the like. The smartphone may communicate with the management system 200 via broadband, Wi-Fi, cellular communications, and/or the like.

In various embodiments, the daughter card 150 may be configured to only communicate with the computing device 30 during specific time windows. For example, the portion of the daughter card 150 configured to communicate via radio frequency communications may only be turned on during predetermined, periodic, or specific time windows in order to reduce the effect on the battery life and/or energy consumption of the dispenser. The computing device 30 may then communicate with the management system 200 via a wired or wireless network 50.

In various embodiments, dispenser events may be assigned a priority (e.g., high priority, low priority, and/or the like). In various embodiments, the daughter card 150 or management system 200 may configure the priority level of an event. For example, the daughter card 150 may provide the main board 110 with event priority information/data as part of the configuration information. In another example, the priority level assigned to an event may be remotely changed. For example, the management system 200 may provide a command to assign a priority level of an event, which is then received by a daughter card 150 and passed to the main board 110. For example, a product percent remaining event may be assigned the priority level low priority when the remaining product is greater than 50%. The priority level of the product percent remaining event may be assigned the priority level high priority when the remaining product is less than 50%. In another example, the percent remaining event may be assigned the priority level low priority when the percent of product remaining is 100-60%, medium priority when the percent of product remaining is 60-40%, and high priority when the percent of product remaining is less than 40%.

In some embodiments, dispenser information/data associated with a high priority dispenser event may be relayed to the daughter card 150 by the main board 110 (e.g., via the dispenser interface 115) and communicated to the computing device 30 and/or management system 200 in real time or near real time. In some embodiments, dispenser information/data associated with a low priority dispenser event may be relayed to the daughter card 150 by the main board 110 (e.g., via the dispenser interface 115) and stored by the daughter card 150 until the occurrence of a predetermined time window, the daughter card 150 storage reaches a threshold fill level, and/or the like, at which time the dispenser information/data may be communicated to the computing device 30 and/or the management system 200. Thus, dispenser information/data associated with high priority dispenser events may be communicated to the computing device 30 and/or management system 200 in real time or near real time and dispenser information/data associated with low priority dispenser events may be batched and communicated to the computing device 30 and/or management system 200, for example, at the end of a shift, every four hours, during a predetermined time window, and/or the like. Some embodiments may include a medium priority event, and/or the like. For example, dispenser information/data associated with a medium priority event may be stored by the daughter card 150 until either a high priority event occurs and/or the communicating of low priority dispenser information/data occurs and then communicate the dispenser information/data associated with the medium priority dispenser event, and/or the like. It should be understood that a variety of priority levels may be defined, as appropriate for various applications.

In various embodiments, the dispenser 100 may also comprise one or more status indicators. For example, the dispenser 100 may include one or more light emitting diodes (LEDs), one or more liquid crystal displays (LCDs), one or more audible status indicator, one or more tactile status indicators, and/or the like. The status indicators may be configured to indicate to a user that the battery is low, a fault has occurred, the dispenser is actively dispensing, the dispenser is out of product to dispense, and/or the like. In various embodiments, the daughter card may provide dispenser information/data to the main board 110 via the dispenser interface 115 that may override the and/or remotely control the status indicators on the dispenser 100, as described in more detail below.

The daughter card may also provide for an authentication routine before communicating with external systems such as computing device 30 to ensure that only permitted users are able to communicate with the dispenser. In some embodiments, a user's ability to read and/or write parameters (e.g., to provide input events and receive output events) to the dispenser may be controlled by the privileges associated with user and checked via the authentication routine. For example, the computing device 30 and/or the like may be configured to provide a PIN, password, access code, and/or the like to the daughter card 150 before the computing device 30 may provide one or more input events to the daughter card 150 and/or receive dispenser information/data related to one or more output events from the daughter card 150. The access rights granted to the computing device 30 may depend on the PIN, password, access code, and/or the like provided by the computing device 30. These users can be categorized according to type and may only be able communicate certain types of information/data with the dispenser (e.g., the input events that may be provided to the daughter card 150 and/or the dispenser information/data associated output events that may be received from the daughter card 150 may be based on the type of user). For example, the following user categories could be formed:

SuperUser: A user with the highest level of access to the data.

RestrictedUser: A user with restrictions on the data they have access to. There may be multiple levels of Restricted Users needed, and the restrictions could range from access rights (read only vs. read/write), to data set rights (only able to access specific data within an account), to account rights (only able to access data associated with a particular account)

Installer Owner: This user is responsible for setting up a dispenser, including installation information, dispenser configuration, dispenser data configuration, dispenser installation data, and in some embodiments limited account management. The Installer Owner would not necessarily be a SuperUser and have the rights to create/destroy accounts or access multiple accounts.

Maintenance: This user is responsible for the maintenance of the dispenser and could receive alerts from a dispenser for events such as low battery, out of product, etc.

In embodiments of the invention, the daughter card 150 may be provided with one or more sensors for identifying a user of the dispenser. These sensors can interact automatically with corresponding devices carried by the user. In one example, a healthcare worker is required to wear an ID badge including personal identification information that is electronically communicated to the daughter card by way of RFID, WIFI, NFC, infrared etc. The daughter card can record the identification of the user, the particular operations performed by the user (such as the amount of soap dispensed as provided by the main dispenser board) and the time/date of use by the particular user.

Exemplary Management Systems 200

A management system 200 may be operated by and/or on behalf of an individual or organization interested in tracking the use of one or more dispensers 100 and/or the use by individual users. In various embodiments, multiple management systems 200 may be used for tracking the use of one or more dispensers 100. As noted above, in various embodiments, a variety of other external computing systems (e.g., point-of-sale systems, inventory management systems, order management systems, operations management systems, and/or the like) may be used in place of and/or in addition to a management system 200 as appropriate for the application.

FIG. 2 shows a schematic diagram of an exemplary management system 200. In other embodiments, the management system 200 and/or other external computing systems may have similar or modified architectures to that described herein with respect FIG. 2, as appropriate for the application. In general, the term system may refer to, for example, one or more computers, computing devices, computing entities, mobile phones, desktops, tablets, notebooks, laptops, distributed systems, servers, blades, gateways, switches, processing devices, processing entities, relays, routers, network access points, base stations, the like, and/or any combination of devices or entities adapted to perform the functions, operations, and/or processes described herein. Such functions, operations, and/or processes may include, for example, transmitting, receiving, operating on, processing, displaying, storing, determining, creating/generating, monitoring, evaluating, comparing, and/or similar terms used herein interchangeably. In one embodiment, these functions, operations, and/or processes can be performed on data, content, information, and/or similar terms used herein interchangeably.

As indicated, in at least one embodiment, the management system 200 may also include one or more communications interfaces for communicating with various computing entities, such as by communicating data, content, information, and/or similar terms used herein interchangeably that can be transmitted, received, operated on, processed, displayed, stored, and/or the like. For instance, the management system 200 may communicate with one or more computing devices 30 and/or one or more dispensers 100.

In one embodiment, the management system 200 may include or be in communication with one or more processing elements 210 (also referred to as processors, processing circuitry, and/or similar terms used herein interchangeably) that communicate with other elements within the management system 200 via a bus 201, for example. As will be understood, the processing element 210 may be embodied in a number of different ways. For example, the processing element may be embodied as one or more complex programmable logic devices (CPLDs), microprocessors, multicore processors, coprocessing entities, application-specific instruction-set processors (ASIPs), and/or controllers. Further, the processing element 210 may be embodied as one or more other processing devices or circuitry. The term circuitry may refer to an entirely hardware embodiment or a combination of hardware and computer program products. Thus, the processing element 210 may be embodied as integrated circuits, application specific integrated circuits (ASICs), field programmable gate arrays (FPGAs), programmable logic arrays (PLAs), hardware accelerators, other circuitry, and/or the like. As will therefore be understood, the processing element 210 may be configured for a particular use or configured to execute instructions stored in volatile or non-volatile media or otherwise accessible to the processing element. As such, whether configured by hardware or computer program products, or by a combination thereof, the processing element 210 may be capable of performing steps or operations according to embodiments of the present invention when configured accordingly.

In one embodiment, the management system 200 may further include memory or be in communication with memory 216, which may comprise non-volatile media (also referred to as non-volatile storage, memory, memory storage, memory circuitry and/or similar terms used herein interchangeably). In one embodiment, the non-volatile storage or memory 216 may include one or more non-volatile storage or memory media as described above, such as hard disks, ROM, PROM, EPROM, EEPROM, flash memory, MMCs, SD memory cards, Memory Sticks, CBRAM, PRAM, FeRAM, RRAM, SONOS, racetrack memory, and/or the like. As will be recognized, the non-volatile storage or memory media may store databases, database instances, database management systems, data, applications, programs, program modules, scripts, source code, object code, byte code, compiled code, interpreted code, machine code, executable instructions, and/or the like. For example, the non-volatile storage or memory may store code including tracking module 230, reporting module 235, and/or one or more other modules. The term database, database instance, database management system, and/or similar terms used herein interchangeably may refer to a structured collection of records or data that is stored in a computer-readable storage medium, such as via a relational database, hierarchical database, and/or network database. For example, the non-volatile storage or memory may comprise a tracking database 240.

In one embodiment, the memory 216 may further comprise volatile media (also referred to as volatile storage, memory, memory storage, memory circuitry and/or similar terms used herein interchangeably). In one embodiment, the volatile storage or memory may also include one or more volatile storage or memory media as described above, such as RAM, DRAM, SRAM, FPM DRAM, EDO DRAM, SDRAM, DDR SDRAM, DDR2 SDRAM, DDR3 SDRAM, RDRAM, RIMM, DIMM, SIMM, VRAM, cache memory, register memory, and/or the like. As will be recognized, the volatile storage or memory media may be used to store at least portions of the databases, database instances, database management systems, data, applications, programs, program modules, scripts, source code, object code, byte code, compiled code, interpreted code, machine code, executable instructions, and/or the like being executed by, for example, the processing element. Thus, the databases, database instances, database management systems, data, applications, programs, program modules, scripts, source code, object code, byte code, compiled code, interpreted code, machine code, executable instructions, and/or the like may be used to control certain aspects of the operation of the management system 200 with the assistance of the processing element 210 and operating system 220.

In various embodiments, memory 216 can be considered primary memory such as RAM memory or other forms which retain the contents only during operation, or it may be a non-volatile memory, such as ROM, EPROM, EEPROM, FLASH, or other types of memory that retain the memory contents. In some embodiments, the disk storage may communicate with the processor 210 using an I/O bus instead of a dedicated bus. The memory 216 could also be secondary memory, such as disk storage, that stores a relatively large amount of data. The secondary memory may be a floppy disk, hard disk, compact disk, DVD, or any other type of mass storage type known to those skilled in the computer arts. The memory 216 may also comprise any application program interface, system, libraries and any other data by the processor to carry out its functions. ROM 215 is used to store a basic input/output system 226 (BIOS), containing the basic routines that help to transfer information/data between components of the management system 200, including the tracking module 230, the reporting module 235, the tracking database 240, and/or the operating system 220.

In addition, the management system 200 includes at least one storage device 213, such as a hard disk drive, a floppy disk drive, a CD-ROM drive, or optical disk drive, for storing information/data on various computer-readable media, such as a hard disk, a removable magnetic disk, or a CD-ROM disk. As will be appreciated by one of ordinary skill in the art, each of these storage devices 213 is connected to the system bus 201 by an appropriate interface. It is important to note that the computer-readable media described above could be replaced by any other type of computer-readable media known in the art. Such media include, for example, memory sticks (e.g., USB memories), magnetic cassettes, flash memory cards, digital video disks, and Bernoulli cartridges.

A number of program modules may be stored by the various storage devices and within RAM 217. Such program modules include the operating system 220, the tracking module 230 (e.g., for receiving, storing, and/or processing dispenser information/data), and/or the reporting module 235 (e.g., for providing information/data to one or more users). Those skilled in the art will appreciate that other modules may be present in RAM 217 to effectuate the various embodiments of the present invention. Furthermore, the functions of the tracking module 230 and/or the reporting module 235 need not be modular.

Various information/data can be received by the management system 200 via the network interface 208 and/or input/output device 204. This information/data may include usage information/data related to a particular dispenser, information/data related to a user who has used the dispenser and/or the like. This input information/data may vary, however, depending on the configuration and informational requirements of the management system 200.

In various embodiments, the management system 200 may be configured to track dispenser usage and generate reports related to dispenser usage. The management system 200 may be further configured to access hygiene protocol information and compare the tracked dispenser usage with the appropriate hygiene protocol information. Additionally, the management system 200 may be configured to receive dispenser information and/or transmit reports to one or more computing devices 30. In another example embodiment wherein the external computing system comprises a point-of-sale system, the point-of-sale system may be configured to provide dispense instructions to the dispenser 100 via the daughter card 150 based on a particular order and/or the like. For example, in response to an order being entered into a point-of-sale system in a foodservice setting, the point-of-sale system may send dispense instructions to cutlery, condiment, and napkin dispensers via each dispenser's respective daughter card 150. In another example embodiment wherein the external computing system comprises a diagnostic system, the diagnostic system may be configured to diagnose one or more faults associated with the dispenser. In yet another example embodiment wherein the external computing system comprises an inventory management system, the inventory management system may be configured to instruct maintenance users when maintenance for various dispensers is needed, determine when additional product to be dispensed by the dispenser should be ordered, order additional product to be dispensed via the dispenser, and/or the like.

Those skilled in the art will recognize that many other alternatives and architectures are possible and can be used to practice various embodiments of the invention. The embodiment illustrated in FIG. 2 can be modified in different ways or incorporated within a network and be within the scope of the invention. For example, one or more components of the management system 200 may be located remotely from other management system 200 components, such as in a distributed system. Furthermore, one or more of the components may be combined and additional components performing functions described herein may be included or associated with the management system 200. Thus, the management system 200 can be configured to accommodate a variety of needs and circumstances.

Exemplary Computing Devices 30

A computing device 30 may be any computing entity configured to receive dispenser information from a dispenser 100, send, transmit, and/or provide configuration information and/or commands to a dispenser 100, provide dispenser information to a management system 200, and/or receive one or more reports related to dispenser information. A computing device 30 may include one or more components that are functionally similar to those of the management system 200. In general, the terms device, system, computing entity, entity, and/or similar words used herein interchangeably may refer to, for example, one or more computers, computing entities, desktops, mobile phones, smartphones, tablets, phablets, notebooks, laptops, handheld computing devices, mobile computing devices, wearable computing devices, distributed systems, gaming consoles (e.g., Xbox, Play Station, Wii), portable game consoles (e.g., Game Boy, Nintendo DS), watches, glasses, key fobs, radio frequency identification (RFID) tags, ear pieces, scanners, cameras, wristbands, kiosks, input terminals, servers or server networks, blades, gateways, switches, processing devices, processing entities, set-top boxes, relays, routers, network access points, base stations, bridges the like, and/or any combination of devices or entities adapted to perform the functions, operations, and/or processes described herein. In one non-limiting example, the computing device 30 is a smartphone operating a mobile application configured to communicate with one or more daughter cards 150.

Figure 4:
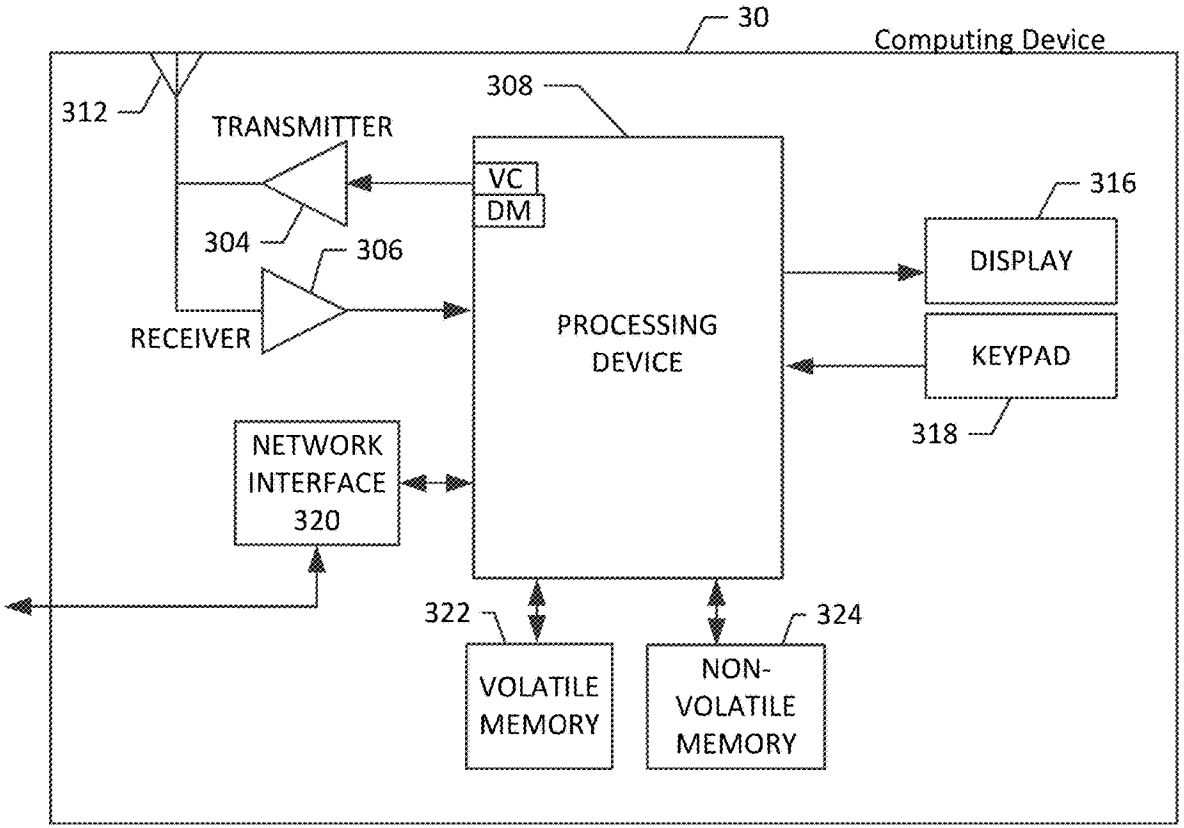
FIG. 4 is an exemplary schematic diagram of a computing device according to one embodiment of the present invention.

FIG. 4 provides an illustrative schematic representative of a computing device 30 that can be used in conjunction with embodiments of the present invention. As shown in FIG. 4, the computing device 30 can include an antenna 312, a transmitter 304 (e.g., radio), a receiver 306 (e.g., radio), and a processing element 308 (e.g., CPLDs, microprocessors, multi-core processors, coprocessing entities, ASIPs, microcontrollers, and/or controllers) that provides signals to and receives signals from the transmitter 304 and receiver 306, respectively.

The signals provided to and received from the transmitter 304 and the receiver 306, respectively, may include signaling information/data in accordance with air interface standards of applicable wireless systems. In this regard, the computing device 30 may be capable of operating with one or more air interface standards, communication protocols, modulation types, and access types. More particularly, the computing device 30 may operate in accordance with any of a number of wireless communication standards and protocols, such as those described above with regard to the management system 200. In a particular embodiment, the computing device 30 may operate in accordance with multiple wireless communication standards and protocols, such as UMTS, CDMA2000, 1×RTT, WCDMA, TD-SCDMA, LTE, E-UTRAN, EVDO, HSPA, HSDPA, Wi-Fi, WiMAX, UWB, IR, NFC, Bluetooth, BLE, USB, and/or the like. Similarly, the computing device 30 may operate in accordance with multiple wired communication standards and protocols, such as those described above with regard to the management system 200 via a network interface 320.

Via these and/or other communication standards and protocols, the computing device 30 can communicate with various other entities using concepts such as Unstructured Supplementary Service Data (USSD), Short Message Service (SMS), Multimedia Messaging Service (MMS), Dual-Tone Multi-Frequency Signaling (DTMF), and/or Subscriber Identity Module Dialer (SIM dialer). The computing device 30 can also download changes, add-ons, and updates, for instance, to its firmware, software (e.g., including executable instructions, applications, program modules), and operating system.

According to one embodiment, the computing device 30 may include a location determining aspects, device, module, functionality, and/or similar words used herein interchangeably. For example, the computing device 30 may include outdoor positioning aspects, such as a location module adapted to acquire, for example, latitude, longitude, altitude, geocode, course, direction, heading, speed, universal time (UTC), date, and/or various other information/data. In one embodiment, the location module can acquire data, sometimes known as ephemeris data, by identifying the number of satellites in view and the relative positions of those satellites. As a non-limiting example, the location information/data can be determined by triangulating the computing device's 30 position in connection with a variety of other systems, including cellular towers, Wi-Fi access points, accelerometers, gyroscopes, and/or the like. Similarly, the computing device 30 may include indoor positioning aspects, such as a location module adapted to acquire, for example, latitude, longitude, altitude, geocode, course, direction, heading, speed, time, date, and/or various other information/data. Some of the indoor systems may use various position or location technologies including RFID tags, indoor beacons or transmitters, Wi-Fi access points, cellular towers, nearby computing devices (e.g., smartphones, laptops) and/or the like. For instance, such technologies may include the iBeacons, Gimbal proximity beacons, Bluetooth Low Energy (BLE) transmitters, NFC transmitters, and/or the like. These indoor positioning aspects can be used in a variety of settings to determine the location of someone or something to within inches or centimeters.

The computing device 30 may also comprise a user interface (that can include a display 316 coupled to a processing element 308) and/or a user input interface (coupled to a processing element 308). For example, the user interface may be a mobile application, a user application, browser, user interface, and/or similar words used herein interchangeably executing on and/or accessible via the computing device 30 to interact with and/or cause display of information/data from the dispenser 100 and/or management system 200, as described herein. The user interface may be activated, commissioned, and/or the like by the user providing a PIN, password, access code, initiating the user interface, and/or the like. The user input interface can comprise any of a number of devices allowing the computing device 30 to receive data, such as a keypad 318 (hard or soft), a touch display, voice/speech or motion interfaces, or other input device. In embodiments including a keypad 318, the keypad 318 can include (or cause display of) the conventional numeric (0-9) and related keys (#, *), and other keys used for operating the computing device 30 and may include a full set of alphabetic keys or set of keys that may be activated to provide a full set of alphanumeric keys. In addition to providing input, the user input interface can be used, for example, to activate or deactivate certain functions, such as screen savers and/or sleep modes, to enter a PIN, password, access code, initiate the user interface, and/or the like.

The computing device 30 can also include volatile storage or memory 322 and/or non-volatile storage or memory 324, which can be embedded and/or may be removable. For example, the non-volatile memory may be ROM, PROM, EPROM, EEPROM, flash memory, MMCs, SD memory cards, Memory Sticks, CBRAM, PRAM, FeRAM, NVRAM, MRAM, RRAM, SONOS, FJG RAM, Millipede memory, racetrack memory, and/or the like. The volatile memory may be RAM, DRAM, SRAM, FPM DRAM, EDO DRAM, SDRAM, DDR SDRAM, DDR2 SDRAM, DDR3 SDRAM, RDRAM, TTRAM, T-RAM, Z-RAM, RIMM, DIMM, SIMM, VRAM, cache memory, register memory, and/or the like. The volatile and non-volatile storage or memory can store databases, database instances, database management systems, data, applications, programs, program modules, scripts, source code, object code, byte code, compiled code, interpreted code, machine code, executable instructions, and/or the like to implement the functions of the computing device 30. As indicated, this may include a user application that is resident on the entity or accessible through a browser or other user interface for communicating with the launch system 100 and/or various other computing entities. For example, a user may use the computing device 30 to access a user interface provided in association with the dispenser 100 or by a management system 200 configured to provide tracking information/data, dispenser information/data, and/or the like.

In another embodiment, the computing device 30 may include one or more components or functionality that are the same or similar to those of the management system 200, as described in greater detail above. As will be recognized, these architectures and descriptions are provided for exemplary purposes only and are not limiting to the various embodiments.

Exemplary Operation

Figure 5:
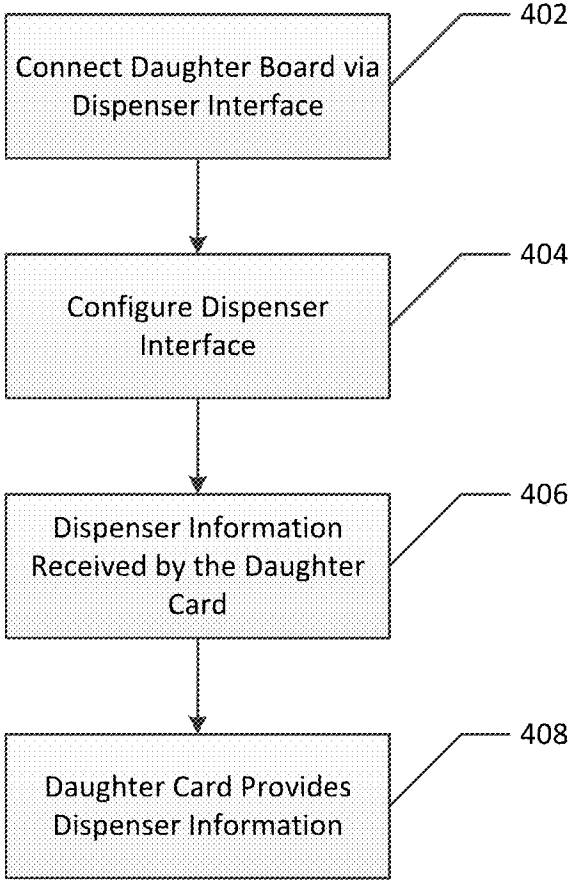
FIG. 5 is a flowchart illustrating operations and processes that can be used in accordance with various embodiments of the present invention.

FIG. 5 illustrates an exemplary process and operations associated therewith that may be completed in accordance with various embodiments of the present invention. In certain embodiments, the dispenser 100 may be manufactured without the daughter card 150. If a dispenser 100 is to be used in an application wherein communication and/or tracking of dispenser usage may be preferred, a daughter card 150 may be added to the dispenser by way of the dispenser interface according to embodiments of the invention. At step 402, the daughter card 150 is connected to the main board 110 via the dispenser interface 115 and the connection 140. For example, the daughter card 150 may be connected to the main board via dispenser interface 115 by plugging a ribbon connector into the appropriate connector receiver on the daughter card 150 and/or the main board 110. In another example, the daughter card 150 may be connected to the main board 110 via a direction connection between the daughter card 150 and the main board 110. In various embodiments, the daughter card 150 is powered via the connection 140. For example, the daughter card 150 may be powered by electrical power provided by the power supply 120 via the main board 110 and connection 140. In some embodiments, the daughter card may be independently powered (e.g., have its own battery and/or other power supply associated therewith) as may be necessary if the connection between the main board 110 and the daughter card is a wireless connection.

In various embodiments, the daughter card 150 is programmed with configuration information and/or communication preferences appropriate for the application before the daughter card 150 is installed into the dispenser 100. In some embodiments, the configuration information and/or communication preferences programmed into the daughter card 150 may be modified via a wired or wireless connection with an appropriate computing device (e.g., computing device 30, management system 200, and/or the like). In some such embodiments, the daughter card 150 may reconfigure the dispenser interface 115 with the new configuration information and/or communication preferences by requesting the dispenser interface enter a configuration mode, pushing the reconfiguration information to the dispenser interface, causing the dispenser 100 to automatically restart, and/or the like. In some embodiments, the dispenser 100 may be manually restarted or entered into a configuration mode to initiate the reconfiguration of the dispenser interface 115.

At step 404, the dispenser interface 115 may be configured. In one embodiment, the daughter card 150 may provide configuration information, calibration information, and/or communication preferences to the dispenser interface 115 upon the dispenser 100 being initialized, turned on, powered up, and/or the like. For example, for a predetermined period of time starting at or shortly after the dispenser 100 is initialized, turned on, powered up, and/or the like, the daughter card 150 may provide one or more signals to the dispenser interface 115 (e.g., via the daughter card interface 155 and connection 140). The signals may indicate to the dispenser interface 115 which communication protocol the dispenser interface 115 should use in communications with the daughter card interface 155. The signals may also include information related to what kinds of dispenser information/data the dispenser interface 115 should communicate to the daughter card 150, what portion of the dispenser information/data should be communicated, how and/or when the dispenser information/data should be communicated, and/or the like. For example, the daughter card 150 may configure the dispenser interface 115 to communicate all of the dispenser information/data related to dispense events, minimal dispenser information/data related to a low battery signal, and no dispenser information/data related to a low reservoir of product to be dispensed. In another example, the daughter card 150 may configure the dispenser interface 115 to communicate minimal dispenser information/data related to a low battery signal in real time or near real time and to store dispenser information/data related to dispense events and communicate the stored dispenser information/data at a later time (e.g., at a predetermined time, when the storage device reaches a threshold fill level, upon request for the information/data, and/or the like). The daughter card 150 may also configure input information/data to be input to the dispenser. Both the dispenser information/data and the input information/data may be configurable for flexibility in the interface. For example, dispenser information/data and input information/data may be set up to be input/output on a serial interface and/or on GPIO ports/pins.

As noted above, the dispenser 100 may comprise a plurality of sensors in communication with the main board 110. The main board 110 may be configured to provide various parameters associated with the sensors or the main board to the daughter card 150 and/or the management system 200 or computing device 30 via the daughter card 150. The daughter card 150 may also be configured to provide information/data/parameters associated therewith to the management system 200 or computing device 30. Examples of parameters that may be provided by the main board 110 (e.g., read from the main board 110 via the daughter card 150) or daughter card 150 comprise the software revision operating on the main board and/or daughter card, the dispenser interface revision, battery level (current voltage reading, percent of battery remaining, percent of battery life remaining, expected battery life remaining, and/or the like), fault status (e.g., if a fault has been detected or not, a fault code, and/or the like), product remaining (e.g., amount of product remaining, percent of product remaining, and/or the like), user sensor state (e.g., user detected, user not detected, and/or the like), motor state (e.g., motor operating, motor not operating, and/or the like), tear switch state (e.g., state of tear switch), start battery level (e.g., battery level when dispenser commissioned, battery level when battery was changed, and/or the like), run battery level (e.g., voltage reading during dispense, and/or the like), motor feedback or cam switch event count (e.g., count of motor feedback or cam switch events, and/or the like; for example, a motor feedback or cam switch event may indicate that the dispense mechanism of a soap dispenser is not in the down or "home" position when it is expected to be), motor stall count (e.g., count of motor stall events, and/or the like), and/or the like.

In various embodiments, the management system 200 or computing device 30 (via the daughter card 150) or the daughter card 150 may be configured to provide (e.g., write) one or more parameters to the main board 110 (or daughter card 150). Examples of parameters that may be written and/or provided to the daughter card 150 or the main board 110 comprise the dispenser type (e.g., soap dispenser, towel dispenser, plastic cutlery dispenser, and/or the like), dispenser serial number (e.g., a unique identification number corresponding to the dispenser, the daughter card, and/or the like), dispenser revision, and/or the like.

Some information/data/parameters may either be received or read from the main board 110 or daughter card 150 or be provided or written to the main board 110 or daughter card 150. These readable and writable information/data/parameters comprise a number of dispenses since reset (e.g., the number of dispense events that have been logged since a reset event was logged, a count of dispense events since memory locally storing the dispense information/data was cleared, and/or the like), delay switch setting (e.g., the setting of the delay switch that may control the length of delay between consecutive dispenses, and/or the like), paper length setting (e.g., the amount of paper dispensed per dispense event in towel length, number of cam clicks, and/or the like), sensor range setting (e.g., the range setting for the user sensor configured to sense the presence of a user, and/or the like), dispense mode setting (e.g., normal operational mode, sleep mode, disable dispense operational mode, fault mode, diagnostic mode, service/maintenance mode, auto sheet length mode (see U.S. patent application Ser. No. 14/604,232, which incorporated by reference herein), configuration mode, hang dispense mode (e.g., when a paper towel is dispensed after the previous towel is taken by a user, a dispense event is triggered when a hanging paper towel is torn off, and/or the like), on demand dispense mode (e.g., a dispense only occurs when a user is detected), or other mode), and/or the like.

At least some of the various information/data/parameters relate to output events experienced by the dispenser and/or a sensor of the dispenser. For example, output events are associated with dispenser information/data. For example, output events occur due to signals generated by the main board 110 and/or generated by components of the dispenser 100 and received by the main board 110. For example, output events may comprise signals generated by the main board 110, a motor configured for dispensing product, a sensor configured for sensing the presence of a user, a switch configured to indicate if a cover associated with the dispenser 100 is open or closed, a sensor or switch configured to monitor the amount of product remaining in the reservoir of product to be dispensed, and/or the like. Some example output events that may be configured include dispensation of product (e.g., soap, sanitizer, towel, or other product is dispensed), referred to as a dispense event herein, the amount of product dispensed at each dispense (for example, if a user tears off the paper towel before the dispenser is finished dispensing, the dispenser will stop the dispense event and the amount dispensed will not be the amount of towel that would otherwise have been dispensed), number of dispenses since a particular event such as a factory reset (e.g., count the number of dispenses since the particular event was logged), dispense time update (e.g., amount dispensed adjusted by adjusting the dispense time), dispense click update (e.g., the amount dispensed adjusted by adjusting the number of motor feedback switch, cam, drive roller switch, or other switch clicks per dispense), and/or the like. Some output events may be associated with sensor or switch states; some example output events include user sensor state change (e.g., the user sensor detects an RFID badge, a request for product dispensation, and/or the like), motor feedback switch state change (e.g., the state of a configuration switch, such as the motor feedback switch, changes), motor state change (e.g., the motor is actuated to dispense product, deactuated to stop dispensing product, and/or the like), dispenser heartbeat (e.g., a periodic pulse from the dispenser indicating the dispenser is still in communication with external device (e.g., management system 200, computing device 30, and/or the like) receiving the dispenser heartbeat), cover switch state change (e.g., cover is opened, cover is closed), dispenser power up (e.g., power up of dispenser initiated), jog tear bar (e.g., tear bar is jogged), delay switch change (e.g., change in delay switch; for example a maintenance worker may manually adjust the delay switch causing the minimum delay between consecutive dispenses to be increased or decreased), paper length switch change (e.g., a change in the amount of product to be dispensed measured in dispense time or motor feedback switch, cam, drive roller switch, or other switch clicks), sensor range switch change (e.g., a change in the dispenser range switch status), dispense mode switch change (e.g., a change in the dispense mode), tear switch state change (e.g., the tear bar moves between the up and down positions or vice versa), and/or the like. Other example output events may be associated with the amount of product remaining in the reservoir of product to be dispensed. For example, output events may comprise reservoir of product to dispense running low (e.g., the supply of towels, soap, or sanitizer at the dispenser is below a threshold value), product fuel gauge (e.g., the product remaining has been reduced by 10%, the product remaining has reached 90%, 80%, 70%, 60%, 50%, 40%, 30%, 20%, 10% of a full reservoir or roll, and/or the like), stub roll fuel gauge (e.g., the amount of towel on the stub roll has reached 90%, 80%, 70%, 60%, 50%, 40%, 30%, 20%, 10% of a full roll and/or the like), stub roll switch (e.g., switch between dispensing from main roll to stub roll or vice versa), product replaced (e.g., the product in the reservoir has been refilled), battery replaced (e.g., the battery or batteries have been replaced), and/or the like. Other example output events may correspond to the state of the power supply 120 or required maintenance, including low battery (e.g., the output voltage of power supply 120 is below a threshold value), battery fuel gauge (e.g., the battery life remaining has been reduced by 10%, the battery life remaining has reached 90%, 80%, 70%, 60%, 50%, 40%, 30%, 20%, 10% of the expected battery life and/or the like), fault occurrence (e.g., a pair of gears become misaligned, a gear does not rotate properly, excessive tear bar jogging, and/or the like), dispenser cleaning needed (e.g., the tube through which soap or sanitizer is dispensed is clogged and/or the like), and occurrence of an enabled event (e.g., any event that is enabled occurs), service event (e.g., a service is performed on the dispenser or in the location of the dispenser), factory reset occurred (e.g., the main board 110 and/or daughter card 150 is reverted to default factory settings), maintenance switch state (e.g., maintenance switch is opened or closed; for example, if the maintenance switch for a soap dispenser is activated, the dispenser is disabled for a predetermined time (e.g., 30 seconds) so that the dispenser may be cleaned without triggering a dispense), and/or the like. Events may be specific to particular types of dispensers. For example, a tear bar jog event may be specific to a paper towel dispenser having a tear bar, and/or the like.

In various embodiments, the information provided by the main board 110 to the daughter card 150 and from the daughter card 150 to the management system 200 or computing device 30 may be configured based on the configuration information/data provided to the main board 110 by the daughter card 150 (and possibly later updated by the management system 200 or the computing device 30 providing new configuration information/data to the daughter card 150). For example, for a dispense event, the dispenser may provide information/data comprising the amount dispensed, the length of time of dispense, the tear bar position, the time of the event, and/or the like. If a fault event occurs, a fault code, timestamp associated with the fault event, and/or the like may be provided. If a motor, switch, or sensor change occurs, information/data identifying the motor, switch, or sensor and the current state of the motor, switch, or sensor may be provided.

Input events may be provided to the main board 110 and/or the daughter card 150 by computing device 30, management system 200, and/or the like (e.g., via the daughter card 150). In various embodiments, the management system 200 may be able to remotely control the dispenser 100 by providing input events to the dispenser 100 via the daughter card 150. In particular, input events are associated with input information/data (e.g., one or more commands). Some examples of input events that may be configured are perform dispense (e.g., trigger the dispensation of product, the command may include an amount to dispense, a length of time to dispense, and/or the like), enter fault mode (e.g., cause the dispenser 100 to enter a fault mode), indicate out of product (e.g., cause the status indicators to indicate that the dispenser is out of product), external heartbeat (e.g., an external periodic pulse to dispenser indicating the external device is still present and in communication with the dispenser), clear latched outputs (e.g., clear any event indicators that are being held), clear memory (e.g., clear the memory located on the main board 110 and/or the like), disable dispense (e.g., cause the dispenser to not dispense product), external low battery (e.g., the output of an external battery is measured to be below a threshold value), set dispenser state (e.g., enter sleep mode, enter configuration mode, enter dispensing mode, enter maintenance mode, enter diagnostic mode and/or initiate diagnostic, enter dispense disabled operating mode, fault mode, Auto Sheet Length Mode (see U.S. patent application Ser. No. 14/604,232, which incorporated by reference herein), reset to factory settings (e.g., main board and/or daughterboard restore factory default settings), update dispense parameter (e.g., length of sheet to be dispensed, amount of soap or hand sanitizer to be dispensed, minimum delay between consecutive dispenses), indicate dispenser (e.g., cause the dispenser to light/flash an LED, perform an audible indicator, jog a motor, and/or the like to indicate to the user a particular dispenser), perform manual feed (e.g., turn manual feed on or off), and update dispenser data parameter (e.g., parameters related to what data is communicated, what data is stored, how data is stored or communicated).

In various embodiments, additional input and/or output events may be defined for particular applications. In some embodiments, hardware handshaking events (e.g., on a serial interface between the daughter card 150 and the dispenser interface 115) may occur. For example, hardware handshaking events may be configured to control information/data flow, initiate a fixed delay to provide the daughter card 150 with a guaranteed time delay to get ready before the information/data is transmitted, and/or the like. In various embodiments, the output and input events may be configured depending on the dispenser and/or application. For example, a towel dispenser having a tear bar may be configured to communicate information/data related to a tear event such as when a jog of the motor is performed to free up the tear bar if it is stuck. Similarly, an event may be communicated when a transfer from the main roll to the stub roll of a paper dispenser occurs. As another example, some dispensers can be provided with both soap product and sanitizer product. Some viruses found in healthcare environments are resistant to soap, while others may be resistant to sanitizer. To ensure that the correct one of the soap or sanitizer or other cleaning agent is provided to the user, the daughter card may be able to determine the correct type of the cleaning agent (such as from an external command or from the ID of a user using the dispenser) and then provide an input event to the main dispenser board to disable the dispensers for the other cleaning agents. In this way, the correct type of cleaning agent can be assured.

In various embodiments, one or more sanitizer dispensers may be located in the same room as a soap dispenser. For example, a sanitizer dispenser may be located near the door of the room and a soap dispenser may be located near a sink located within the room. In various examples, the hand hygiene protocol associated with the room at a particular time may require use of soap and hand washing and not the use of sanitizer. For example, a patient assigned to the room may have a virus, bacteria, spores, fungal infections, germs, or other pathogens, condition, infection, allergy, or the like for which sanitizer would not provide sufficient or appropriate hand hygiene for a healthcare worker providing care to the patient. One example is the *Clostridium difficile*, or *C. diff*, bacteria. After receiving an update to the hand hygiene protocol for the room, or perhaps in response thereto, the management system 200, computing device 30, or another appropriate computing device may provide a remote command to the daughter card 150 of the sanitizer dispenser to disable the sanitizer dispenser; cause the sanitizer dispenser to flash a red light; cause a graphical interface to display information related to the appropriate hand hygiene protocol for the room, the location of the nearest soap dispenser/hand washing station, and/or the like; and/or otherwise indicate to a healthcare worker or other user that compliance with the hand hygiene protocol for the room requires the user to wash their hands, use the soap dispenser and/or the like.

In various embodiments, a healthcare worker or other user may wear a wearable sanitizer dispenser that is in communication with the management system 200 and/or the computing device 30. The wearable dispenser may also be configured to receive a remote command provided by the management system 200, computing device 30, or other appropriate computing entity when the user and the wearable dispenser are in the vicinity of an area or room in which the hand hygiene protocol requires the use of hand washing with soap and not the use of sanitizer. The remote command may disable the sanitizer dispenser; cause the sanitizer dispenser to flash a red light; cause a graphical interface to display information related to the appropriate hand hygiene protocol for the room, the location of the nearest soap dispenser/hand washing station, and/or the like; and/or otherwise indicate to a healthcare worker or other user that compliance with the hand hygiene protocol for the room requires the user to wash their hands, use the soap dispenser and/or the like. Therefore, the dispensers located within a physical location may be remotely controlled (by the management system 200, computing device 30, or other appropriate computing device) in order to assist users in complying with hand hygiene protocols that may change based on conditions within, around, and/or associated with the physical location.

Returning to FIG. 5, at step 406, dispenser information/data is received by the daughter card. For example, a dispenser event may occur, causing the main board 110 to receive and/or generate a trigger or other signal indicating a dispense event. The dispenser interface 115 may communicate the dispenser information to the daughter card 150 via the connection 140 and the daughter card interface 155 in accordance with the configuration information and/or communication preferences. In various embodiments, the received dispenser information/data may be stored in memory associated with the daughter card 150 (e.g., memory onboard the daughter card, memory local to the daughter card, and/or memory in communication with the daughter card). Input information/data may also be received by the dispenser interface 115. For example, as noted above, an input event may be to dispense product or to disable dispensing of product. Therefore, dispenser 100 may receive input (e.g., via the daughter card 150 via the dispenser interface 115) from a remote computing entity (e.g., the management system 200, computing device 30, or other appropriate computing entity) to dispense product or to disable dispensation of the product. For example, the dispenser 100 could be remotely turned off for the weekend, the dispenser firmware could be upgraded remotely, the status indicators could be remotely controlled, stored dispenser information/data and/or input information/data could be read, written, and/or deleted remotely, real time data export could be enabled or disabled remotely, the stored configuration may be remotely updated or changed, the test, diagnostic, and/or manufacturing test modes could be remotely entered or initiated, and/or the like. For example, the diagnostic mode may be entered to diagnose the cause of one or more faults. In various embodiments, the state of a configuration switch may be remotely reconfigured via the daughter card 150 providing reconfiguration information/data to the dispenser interface 115. For example, the length of a sheet of towel that the dispenser dispenses or the amount of soap/sanitizer a dispenser dispenses may be remotely adjusted. As another example, a new dispensing algorithm or a new custom dispensing mode may be developed and provided to the dispenser via the daughter card 150. For example, the new algorithm or new dispensing mode may be provided to the daughter card 150 of a dispenser 100 and the daughter card 150 may provide the new algorithm or new dispensing mode to the main board 110.

In various embodiments, the configuration information and/or communication preferences may include a priority associated with each event or at least one event. An event associated with a high priority may be communicated to the daughter card 150 in real time or near real time. For example, dispenser information associated with the reservoir of product to be dispensed is running low, a fault occurs, maintenance is required, and/or the like may be indicated as high priority events. An event associated with a low priority may be communicated once a day, at the end of each shift, every few hours, and/or the like. For example, event information related to a dispense event may be indicated as a low priority event. In some embodiments, particular dispense events may be indicated as a high priority event. For example, if a particular individual is on probation for not complying with the hygiene protocol, a dispense event associated with that individual may be indicated as a high priority event, allowing that individual's hygiene activities to be tracked in real time. In some embodiments, some maintenance items may be indicated as low priority events. For example, dispenser information/data indicating that the reservoir of product to be dispensed is 70% empty may be indicated as a low priority event. However, in some embodiments, dispenser information/data indicating that the reservoir of product to be dispensed is 90% empty may be indicated as a high priority event. A variety of other priority levels may be provided in various embodiments. In various embodiments, dispenser information/data may be provided to the daughter card 150 in real time or near real time, regardless of priority.

Figure 6:
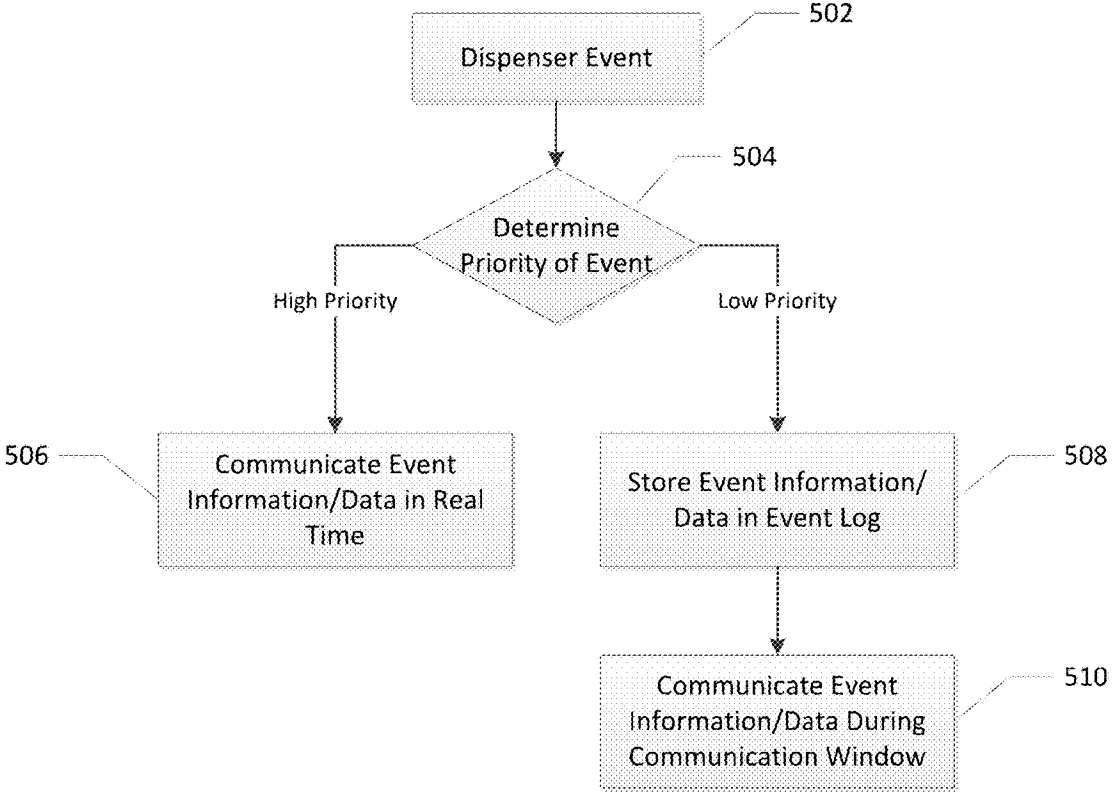
FIG. 6 is a flowchart illustrating operations and processes that can be used to report dispenser events in various embodiments of the present invention.

FIG. 6 provides a flowchart illustrating operations and processes that can be used to communicate dispenser events to the daughter card 150 via the dispenser interface 115 in various embodiments of the present invention. At step 502 a dispenser event may occur and/or associated dispenser information/data may be generated. For example, the dispenser may dispense product, sense a user in the vicinity of the dispenser, generate a low battery signal, and/or the like, as described above herein. At step 504, the main board 110 may determine if the dispenser event is a high priority or low priority event. If the dispenser event is a high priority event, the main board 110 continues to step 506. At step 506, the main board 110 communicates the dispenser information/data to the daughter card 150 (e.g., via the dispenser interface 115) in real time or near real time and in accordance with the configuration information provided by the daughter card 150 to the main board 110. If, at step 504, the main board 110 determines the dispenser event is a low priority event, the main board 110 continues to step 508. At step 508, the main board 110 stores the dispenser information/data for later communication. At step 510, the main board 110 may communicate the stored dispenser information/data to the daughter card 150 (e.g., via the dispenser interface 115) during a communication window and in accordance with the configuration information provided by the daughter card 150 to the main board 110. In various embodiments, the communication window may be a predetermined time period, may be initiated by a request for dispenser information/data from the daughter card 150, management system 200, computing device 30 and/or the like.

Returning to FIG. 5, at step 408, the dispenser information/data may be provided by the daughter card 150 to an external system. For example, the computing device 30 and/or the management system 200 may request dispenser information/data from the daughter card 150. In one non-limiting example, a user may connect a computing device 30 (e.g., a smartphone operating a mobile application) via a USB cord to the dispenser (e.g., via a USB port in communication with the daughter card 150) and request the dispenser information/data via the smartphone application. In one embodiment, a user of the computing device 30 may need to enter a PIN, password, access code, and/or the like to activate and/or commission the computing device 30 and/or an application operating thereon to communicate with the daughter card 150. In other embodiments, the daughter card 150 may automatically provide dispenser information/data to the computing device 30 and/or the management system 200 as the daughter card receives the dispenser information from the dispenser interface 115, at regular time intervals, periodically, when the memory associated with the daughter card is full, nearly full, or reaches a predetermined percentage of full (e.g., 50% full, 75% full, 80% full, 90% full, 95% full), and/or the like. When the dispenser information/data is provided by the daughter card 150 to the computing device 30 and/or the management system 200 (e.g., directly or via a network 50 and/or the computing device 30) may depend on the type of dispenser information/data, and/or a priority level associated with the dispenser information/data as discussed above (e.g., based on the type of dispenser information/data, and/or the like). For example, dispenser information/data associated with a dispense event may be stored and provided periodically and dispenser information/data associated with a low voltage reading of power supply 120 or the reservoir of product to be dispensed is running low may be provided in real time or near real time. For example, dispenser information/data associated with a low priority indicator may be stored and provided periodically and dispenser information/data associated with a high priority indicator may be provided in real time or near real time. In some embodiments, the dispenser interface 115 may be configured to communicate dispenser events and/or dispenser information/data in accordance with configuration information provided by the daughter card 150 in real time or near real time. The daughter card 150 may then follow a process similar to that illustrated in FIG. 6 to determine if the dispenser information/data should be communicated to the computing device 30 and/or management system 200 in real time or near real time or if the dispenser information/data should be stored by the daughter card 150 and communicated to the computing device 30 and/or management system 200 at a later time, based on the priority level of the dispenser event. In various embodiments, the daughter card 150 may time stamp the dispenser information/data upon receipt of the dispenser information/data from the main board 110.

Once the dispenser information/data is received by the management system 200, the dispenser information/data may be stored in memory associated with the management system (e.g., in tracking database 240). The dispenser information/data may be used to track the usage of the dispenser 100, track compliance with the appropriate hygiene protocols, determine when the dispenser power supply 120 needs to be changed, determine when the dispenser needs to be serviced, determine when the reservoir of product to be dispensed needs to be replaced or refilled, and/or the like. The dispenser information/data may also be used to generate one or more reports related to the dispenser information/data.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A product dispenser assembly for dispensing a product, the dispenser comprising:

a dispenser controller having a first communication interface disposed within the dispenser; and a communication controller comprising a second communication interface and a memory, the second communication interface operatively connected to the first communication interface and disposed within the dispenser, the communication controller configured to be in communication with one or more devices, wherein the communication controller is configured to:

receive a command from one of the one or more devices, wherein the command is configured for execution by the dispenser controller; and provide the command to the dispenser controller, and wherein execution of the command by the dispenser controller causes (a) product to be dispensed, (b) dispenser data to be stored, (c) dispenser data to be communicated, (d) a change in how a product is dispensed, or (e) an update to be made to the firmware of the dispenser controller, in accordance with the command.

2. The product dispenser of claim 1 wherein the command is received via at least one of Bluetooth, Bluetooth low energy, Wi-Fi, short range radio communications, cellular network, ANT, or Zig Bee.

3. The product dispenser of claim 1 wherein the device from which the command is received is located in the vicinity of the product dispenser.

4. The product dispenser of claim 3 wherein the device from which the command is received is a second product dispenser located in the vicinity of the product dispenser.

5. The product dispenser of claim 3 wherein the command originates from a computing device that is remotely located from the product dispenser.

6. The product dispenser of claim 1 wherein the device from which the command is received is remotely located from the product dispenser.

7. The product dispenser of claim 1 wherein the command is selected from the group consisting of perform dispense, enter fault mode, indicate out of product, external heartbeat, clear latched outputs, clear memory, disable dispense, external low battery, enter sleep mode, enter configuration mode, enter dispensing mode, enter maintenance mode, enter diagnostic mode, initiate diagnostic test, update configuration switch, update dispenser parameter, reset to factory settings, set dispenser state, indicate dispenser, and update dispenser data parameter.

8. The product dispenser of claim 1 wherein, in response to the command, the communication controller receives dispenser data from the dispenser controller and provides the dispenser data to a remotely located computing device.

9. The product dispenser of claim 8 wherein providing the dispenser data to the remotely located computing device comprises the communication controller providing the dispenser data to one of the one or more devices, wherein the one of the one or more devices is located in a vicinity of the product dispenser.

10. The product dispenser of claim 1 wherein the command comprises one or more firmware updates, wherein the firmware update is an update for at least one of the dispenser controller or the communication controller.

11. A method for controlling a dispenser for dispensing products, the method comprising:

establishing a communication connection with a communication controller, the communication controller (a) operatively connected to a communication interface of a dispenser controller and (b) comprising a memory, the dispenser controller configured to control the dispenser, wherein the dispenser comprises the dispenser controller and the communication controller; and providing a command to the communication controller, the command (a) originating from a remote computing device and (b) configured for execution by the dispenser controller, wherein the communication controller is configured to provide the command to the dispenser controller and wherein execution of the command by the dispenser controller causes (a) product to be dispensed, (b) dispenser data to be stored, (c) dispenser data to be communicated, (d) a change in how a product is dispensed, or (e) an update to be made to the firmware of the dispenser controller, in accordance with the command.

12. The method of claim 11 wherein the communication connection is established via at least one of Bluetooth, Bluetooth low energy, Wi-Fi, short range radio communications, cellular network, ANT, or Zig Bee.

13. The method of claim 11 wherein the communication connection is established by a device located in a vicinity of the dispenser.

14. The method of claim 13 wherein the device is (1) a second product dispenser and (2) located in the vicinity of the dispenser.

15. The method of claim 13 wherein the device is selected from the group consisting of a gateway, a smartphone, a handheld computing device, a laptop, a mobile computing device, or a wearable computing device.

16. The method of claim 13 wherein the device is in communication with the remote computing device.

17. The method of claim 11 wherein the communication connection is established by the remote computing device.

18. The method of claim 11 wherein the command is selected from the group consisting of perform dispense, enter fault mode, indicate out of product, external heartbeat, clear latched outputs, clear memory, disable dispense, external low battery, enter sleep mode, enter configuration mode, enter dispensing mode, enter maintenance mode, enter diagnostic mode, initiate diagnostic test, update configuration switch, update dispense parameter, reset to factory settings, set dispenser state, indicate dispenser, and update dispenser data parameter.

19. The method of claim 11 wherein, in response to the command, the communication controller receives dispenser data from the dispenser controller and provides the dispenser data to the remote computing device.

20. The method of claim 19 wherein providing the dispenser data to the remote computing device comprises the communication controller providing the dispenser data to a device located in the vicinity of the dispenser.

21. The method of claim 20 wherein the device located in the vicinity of the dispenser provides the dispenser data to the remote computing device.

22. The method of claim 11 wherein the command comprises one or more firmware updates, wherein the firmware update is an update for at least one of the dispenser controller or the communication controller.

* * * * *